US006199601B1

(12) United States Patent
Laudenberg

(10) Patent No.: US 6,199,601 B1
(45) Date of Patent: Mar. 13, 2001

(54) METHOD AND APPARATUS FOR FILLING FLEXIBLE POUCHES

(75) Inventor: Bernd Laudenberg, Wipperfurth (DE)

(73) Assignee: Profile Packaging, Inc., Sarasota, FL (US)

( * ) Notice: Under 35 U.S.C. 154(b), the term of this patent shall be extended for 0 days.

(21) Appl. No.: 09/024,510

(22) Filed: Feb. 17, 1998

(51) Int. Cl.[7] ..... B65B 1/04
(52) U.S. Cl. ..... 141/48; 141/114; 141/313
(58) Field of Search ..... 141/48, 49, 66, 141/93, 114, 313, 314, 315, 317

(56) References Cited

U.S. PATENT DOCUMENTS 4,326,568 * 4/1982 Burton et al. ..... 141/114
4,848,421 * 7/1989 Froese et al. ..... 141/114
4,999,978 * 3/1991 Kohlbach et al. ..... 141/48
5,267,591 * 12/1993 Wakabayashi et al. ..... 141/93
5,485,714 * 1/1996 Montalvo ..... 141/114

* cited by examiner

*Primary Examiner*—Steven O. Douglas
(74) *Attorney, Agent, or Firm*—Gifford, Krass, Groh, Sprinkle, Anderson & Citkowski, P.C.

(57) ABSTRACT

A method and apparatus for filling flexible pouches with products such as beverages, shredded cheese, and chips. The filling apparatus includes a hood having a dispersion plate for delivering jets of gas such as nitrogen or carbon dioxide over the tops of empty, open, flexible pouches. The pouches are moved under the hood by a turret. Diving nozzles are lowered into the pouches to purge oxygen from the pouches. The pouches are moved by the turret to a fill tube which dispenses liquid into the pouch and then to a downstream purging station where a second diving nozzle is lowered to the top of the pouch to purge any remaining oxygen from the pouch.

14 Claims, 3 Drawing Sheets

40
58
72
62
12
50
74
68
28
22
68
66
64
60
30
40

METHOD AND APPARATUS FOR FILLING FLEXIBLE POUCHES

BACKGROUND OF THE INVENTION

I. Field of the Invention

A method and apparatus for filling flexible pouches with fluids and powders and, more particularly, a method and apparatus having a hood providing a gas curtain for covering a pouch during the filling process.

II. Description of the Prior Art

Flexible pouches formed of plastic or foil are used for packaging fluids. These pouches are being used for a variety of different fluids, including liquids, granular material, powders and the like. The pouches are typically triangular in shape having a flat base and tapering towards a top. The pouches rest on the base and the beverage is dispensed from the top.

Many liquids and dry products, such as powders, must be packaged in the absence of oxygen. All oxygen is removed from the pouch before filling and the pouch is maintained in an oxygen-reduced environment while being filled. The pouches are placed in a closed chamber which is sealed and evacuated to remove oxygen. The chamber is then filled with a gas such as nitrogen or carbon dioxide. The pouches are then filled in the gas filled environment of the chamber. However, when there is any problem with the fill process, the production line must be stopped while the chamber is opened and the problem corrected. Then the chamber must be reevacuated and filled with gas before continuing the filling process. This can result in lengthy delays in the packaging process.

It is, therefore, an object of this invention to provide a method and apparatus for filling flexible pouches which does not require an evacuation chamber. It is a further object of the invention to provide a method and apparatus for filling flexible pouches which minimizes the down time when there is a problem in the filling process.

SUMMARY OF THE INVENTION

Accordingly, these objects and other advantages are provided by a pouch filling apparatus having a gas dispersing hood extending over a portion of a turret. The hood disperses gas continuously to form a gas curtain which covers the top of the pouch. While under the hood, the pouch is purged at an upstream purging station with a diving nozzle and moved to a filling station where a fill tube dispenses products such as a liquid into the pouch. The pouch is moved by the turret to a downstream purging station where the top of the pouch over the filled product is purged and the pouch is closed.

The hood includes an inner wall and an outer wall which extend downwardly from an upper wall. A dispersion screen extends between the inner and outer walls beneath the upper wall to form a chamber for holding pressurized gas. The dispersion screen has holes which form jets of gas which form a gas curtain. The turret moves the pouches along a passageway formed under the dispersion screen through the gas curtain from the upstream purge station to the fill station and then to the downstream purge station.

The upstream purging station includes a pair of diving nozzles mechanically lowered into the pouch to inject pressurized gas into the pouch to purge oxygen. The fill station includes a fill tube mechanically lowered into the pouch and liquid is dispensed into the pouch. A collar is mounted to the hood to extend about the fill tube. The collar is connected to the supply of pressurized gas and directs gas around the tube to act as a seal.

The downstream purging station includes a second pair of diving nozzles which are mechanically lowered into the top of the pouch above the filled liquid. The pouch is closed and the nozzles inject gas into the pouch to further purge any remaining oxygen from the pouch. The pouch is then moved from under the hood to a sealing station where the pouch is sealed and then, finally, to a discharge station where the pouch is unloaded from the turret. If any problems occur during the fill process the problem can be corrected without stopping production while evacuating a chamber.

BRIEF DESCRIPTION OF THE DRAWINGS

The present invention will be more fully understood by reference to the following detailed description, when read in conjunction with the accompanying drawings, in which like reference characters refer to like parts throughout the several views an which.

DETAILED DESCRIPTION OF THE PREFERRED EMBODIMENTS

Figure 1:
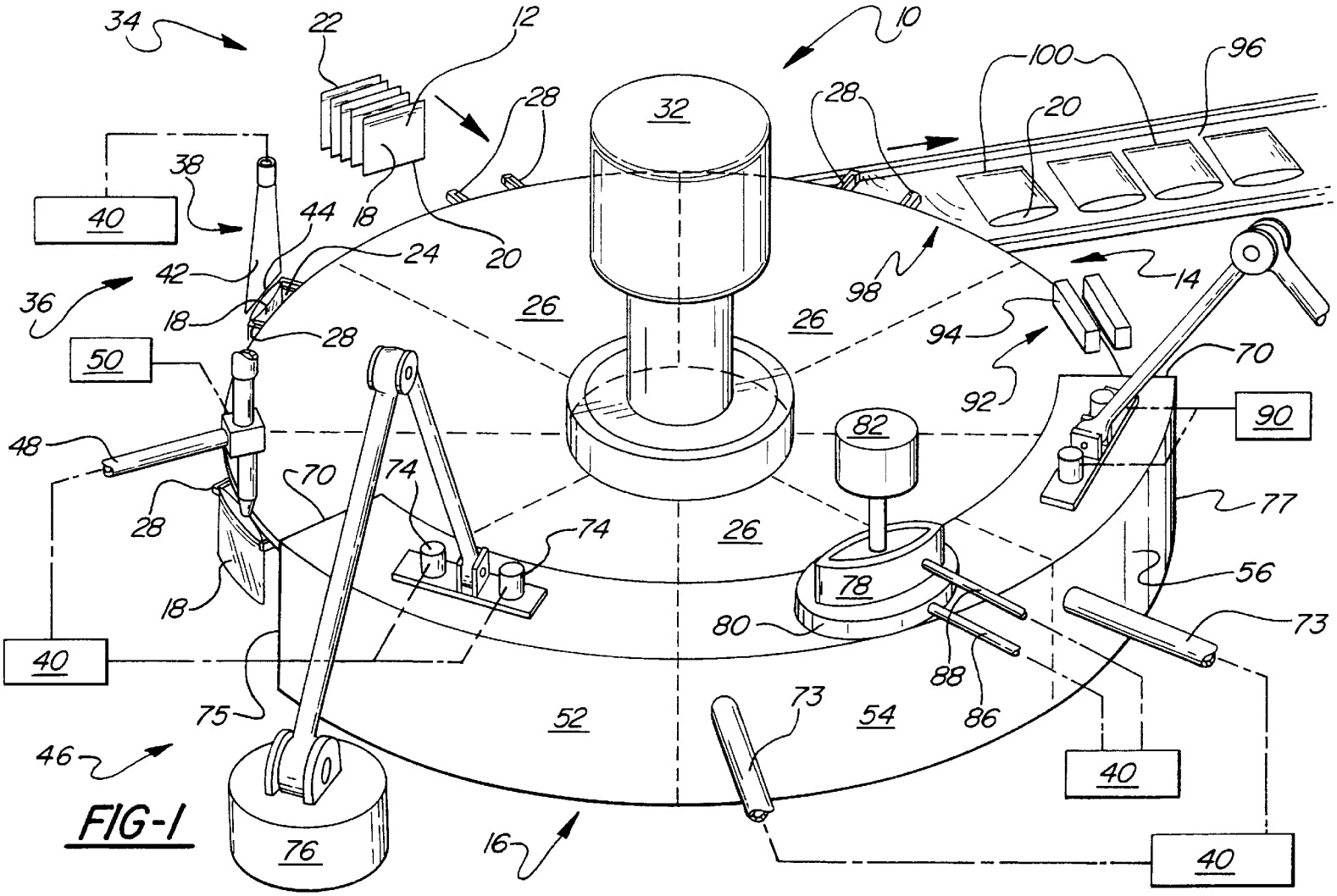
FIG. 1 is a partial perspective view of a turret of a filling apparatus in accordance with the invention.
Figure 2:
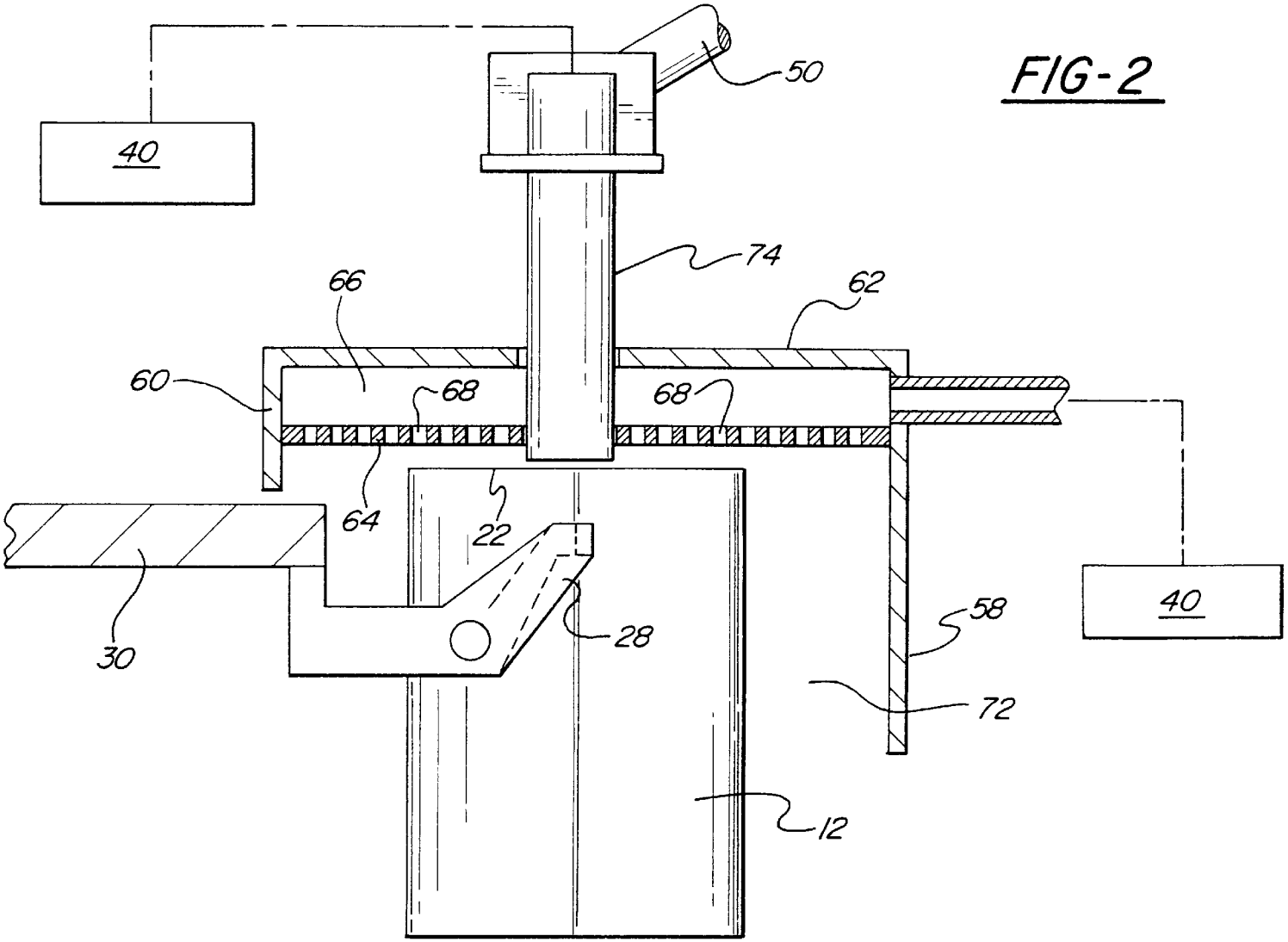
FIG. 2 is a cross-sectional view of a hood with a pouch suspended by a hood with a pouch suspended by a turret arm beneath a diving nozzle.
Figure 3:
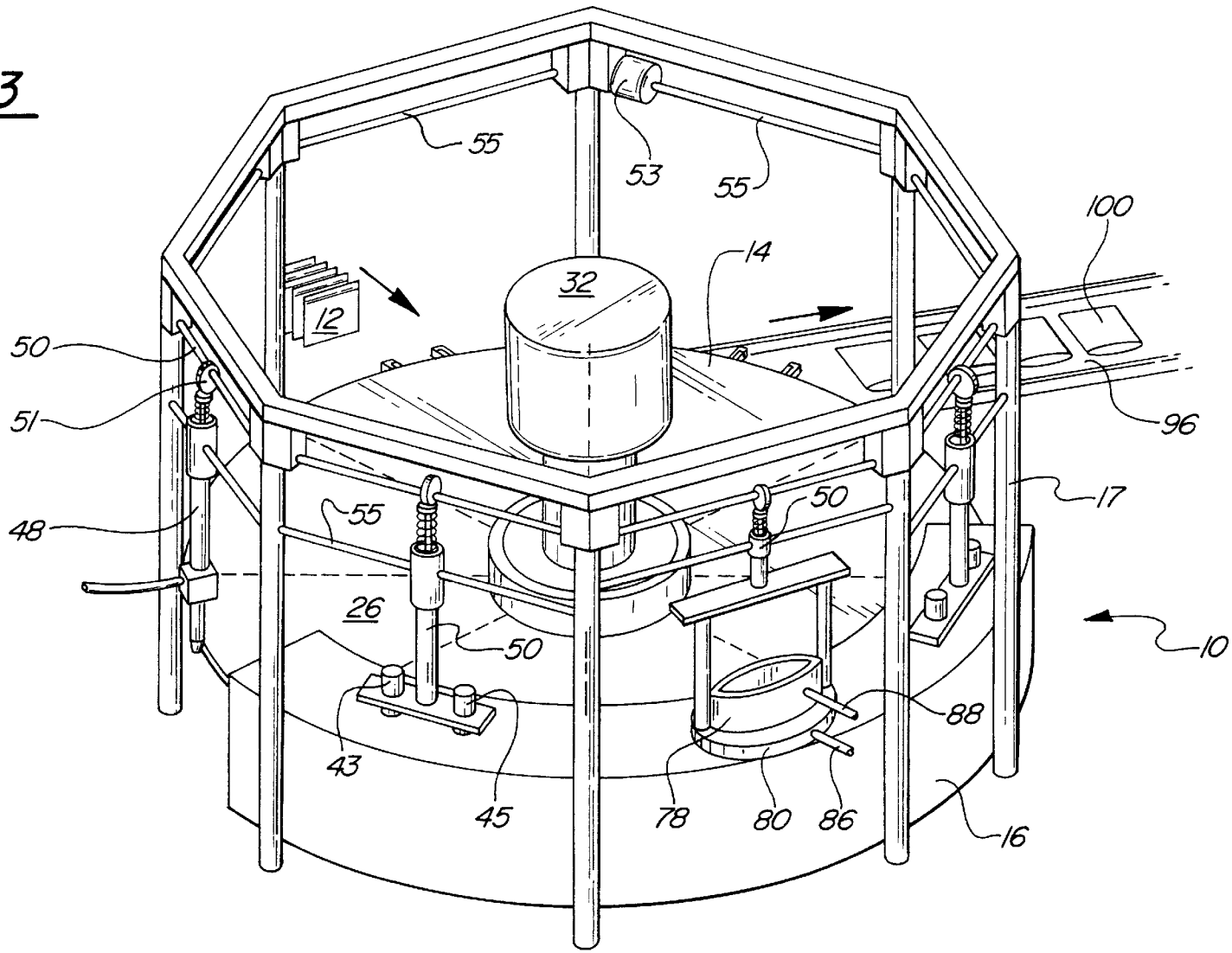
FIG. 3 is a partial perspective view of the apparatus according to the invention.

An apparatus 10 for filling flexible pouches 12 with liquids or dry products is shown in FIGS. 1–3. The apparatus 10 shown is particularly adapted for liquids, but the apparatus 10 may be used for dry products such as powders, chips, shredded cheese, dog food, etc. The filling apparatus 10 includes a turret 14 and a hood 16 which are supported on a frame 17. As shown in FIG. 2, the flexible pouches 12 are formed of flexible plastic sheets having a pair of side panels 18 which taper together from a bottom panel 20 to a top 22. The pouches may include a pair of gussets (not shown) which extend between the bottom 20 and the panels 18 and taper upwardly to the top 22. The top 22 of each of the panels defines an opening 24 for filling. Although described for use with tapered pouches, the apparatus can be used for filling other types of pouches and containers.

As shown in FIG. 1, the turret 14 is sequentially rotated in a counterclockwise direction through each of eight stations. The turret 14, thus, has eight sectors 26. Each sector 26 has one or more pairs of conventional grippers 28 mounted to ends of arms 30 (FIG. 2). The grippers hold the panels of the pouches 12 while the turret 14 is rotated from station to station. A motor 32 is mounted to the frame to rotate the turret. The motor 32 is under the control of a CPU (not shown) to periodically rotate the turret 14 and move the grippers 28 of one sector 26 from station to station. Each sector 26 may have one or more pairs of grippers 28. As discussed in co-pending application Ser. No. 08/970,679 now U.S. Pat. No. 5,845,466, filed Nov. 14, 1997, several pairs of grippers 28 can be positioned at each station.

As shown in FIG. 1, the first station is a loading station 34. The empty pouches 12 are delivered to the grippers 28 by an overhead transfer clamp (not shown). Each gripper 28 is operable to grasp one of the side panels 18 near the top of the pouch. The second station is a conventional opening station 36 where a conventional gas knife 38 is positioned above each pouch 12. The gas knife 38 is connected to a supply 40 of compressed gas such as nitrogen or $CO_2$. The knife has an elongated lower end 42 with a slit 44 to direct gas downwardly against the tops 22 of the panels of the pouch 12 to assist in opening the pouch 12 as the grippers of each pair are moved together in a conventional fashion to open the pouch 12 for filling.

As shown in FIGS. 1 and 2, at the third station 46, a diving nozzle 48 is positioned for lowering into the open pouch 12. The diving nozzle 48 is connected to the supply 40 of compressed gas. The diving nozzle 48 is lowered by a mechanism 50 into the pouch 12 where the CPU controls a supply of gas to further open the pouch 12 and purge oxygen from the pouch 12.

In accordance with the invention, the arcuate hood 16 covers an upstream purging station 52, a fill station 54, and a downstream purging station 56. As shown in FIG. 2, the hood has an outer wall 58 and an inner wall 60 coextending downwardly from an upper wall 62. The outer wall 58 extends downwardly to a position below the gripper arm 30 and the inner wall 60 extends to slightly above the gripper arm 30. A dispersion screen 64 extends between the inner wall 60 and outer wall 58 to form a chamber 66 for holding compressed gas. A pair of vertically extending end walls 70 (FIG. 1) extend downwardly from the upper wall 62 to the screen 64 and from inner wall 60 to outer wall 58 to enclose the chamber 66. The dispersion screen 64 is formed of a sheet of metal or other material having a plurality of perforations 68. The perforations 68 form jets of gas from the chamber which disperses around the top 22 of the pouch to form a curtain to prevent the oxygen from outside of the hood to reach the pouch 12. The perforations 68 have a diameter sufficient to form the curtain, for example, approximately ⅛ inch diameter for a pressure of less than 1 psi. The inner and outer walls 60 and 58 are spaced apart a sufficient distance to form a passageway 72 wide enough to freely accept a filled pouch therebetween. The passageway 72 extends beneath the dispersion screen 64 from an upstream end 75 of the hood 16 to a downstream end 77. A pair of inlets 73 are connected to the supply 40 of pressurized gas to deliver gas into the chamber.

As shown in FIG. 2, the upstream purging station 52 has a pair of diving nozzles 74 which extend through the upper wall 12 and dispersion screen. The nozzles 74 are mounted to a suitable reciprocating apparatus 76 such as a cam 51 connected to the mechanism 50. Thus, a single electric or pneumatic motor 53 to move the nozzles 74 reciprocally in a vertical direction. The nozzles extend through the upper wall 62, chamber 66, and screen 64. The nozzles 74, thus, are moved downwardly into the open pouch 12 and pressurized gas from the supply 40 of gas is delivered under pressure in the pouches 12 to purge oxygen from the open pouches.

As shown in FIG. 1, the fill station 54 includes an oval fill tube 78 mounted to extend through a collar 80 in the upper wall 62 of the hood 14. The fill tube 78 is connected to a supply 82 of liquid which is to be delivered to the pouch. Likewise, the fill tube 78 is connected to the lifting mechanism 50 to move the tube downwardly into to pouch 12 for filling. The collar 80 forms an annular chamber which surrounds the tube 78. An inlet 86 is connected to the source 40 of pressurized gas to deliver gas to the collar 80. Gas from the annular chamber of the collar 80 forms a gas curtain around the tube 78 to form a seal. Likewise, a conduit 88 delivers gas to the fill tube 78 above the collar 80 for introducing pressurized gas to form a curtain around the fill liquid as it enters the pouch 12.

The downstream purging station 56 is located at the downstream end 77 of the hood. A second pair of diving nozzles 90 are positioned to purge any oxygen from the top of the liquid in the pouch. The nozzles 90 are formed in the same way as the nozzles 74. The diving nozzles 90 are moved into the pouch just above the liquid by the raising/lowering mechanism 50. A single raising/lowering mechanism can be used to raise and lower the diving nozzles 48, 74, and 90 and the fill tube 78. This can be done by connecting cam shafts together and connecting the nozzles to respective cam shafts 55. One motor 53 can then be used to move all of the nozzles. The grippers 28 are then moved together to close the pouches and the top of the pouch is purged.

A sealing station 92 is positioned outside of the hood 14. A conventional sealing apparatus 94 is used to seal the pouches 12.

A discharge conveyor 96 is located at an unloading station 98 to receive the filled pouches 100 when they are released by the grippers 28. The belt 96 carries the pouches 100 out for packaging and shipment.

METHOD OF OPERATION

As shown in FIG. 1, the fill apparatus 10 includes a turret 14 which is sequentially turned and indexed in a counterclockwise direction through eight stations. The CPU is used to control the operation of the apparatus. At the loading station 34, the pouches are loaded from a delivery belt unto the turret 14 by the grippers 28 which grasp the opposite side panels 18 of the pouch. The turret 14 is rotated to the opening station 38 where the grippers 28 are moved together to open the pouch and the gas knife 38 blows compressed gas onto the top of the pouch to open the pouch 12. The pouches are then moved to the third station 46 where the diving nozzle 48 is lowered into the pouch. Compressed gas, such as nitrogen or $CO_2$ is blown to expand the gussets outwardly, further opening the pouch and purging oxygen from the pouch. The turret 14 is then moved under the hood 16 to the upstream purging station 52 at the upstream end 75 of the hood. Compressed gas is directed into the passageway 72 through the dispersion screen. The gas forms a curtain to prevent oxygen from getting into the passageway to contaminate the pouches. At the upstream purging station 52, the diving nozzles 48 are then lowered into the pouch 12 and compressed gas is injected into the pouch for a proportional period of time depending on speed to purge oxygen from the interior of the pouch 12.

The turret 14 is then indexed to the fill station 54 where the fill tube 78 is lowered into the pouch to dispense liquid into the pouch 12. At the same time, a curtain of compressed gas is delivered by the collar 80 to encircle the tube to form a seal around the tube 78 to prevent oxygen contamination from outside the hood. Finally, compressed gas is introduced directly into the fill tube 78 for the same purpose.

The turret 14 is then indexed to the downstream purging station 56 where a second pair of diving nozzles 90 are lowered into the top of the pouch over the liquid. The grippers 28 are moved together to close the pouches around the nozzles. A supply of compressed gas is delivered to purge any remaining oxygen from the top of the pouch. After the purge, the nozzles 90 are retracted with the top of the bag closed by the grippers 28. The turret 14 is indexed to the sealing station 92 which is located downstream and outside of the hood. The top of the pouch 12 is then sealed in a conventional manner and the turret 14 is indexed to the unloading station 98 where the grippers 28 are opened and the filled pouches 100 are released onto the delivery conveyor 96 for delivery to a packaging station.

While the present invention has been described in connection with the preferred embodiment of the various figures, it is also understood that other similar embodiments may be used or modifications or additions may be made to the described embodiment for performing the same function of the present invention without deviating therefrom. Therefore, the present invention should not be limited to any single embodiment but, rather, construed in breadth and scope in accordance with the recitation of the appended claims.

I claim:

1. An apparatus for filling a pouch having an opening with a product, said apparatus comprising:

a hood having at least one wall defining a passageway, said passageway being open to air from outside said hood, said hood having means for dispersing pressurized gas into said passageway to displace said air from outside said hood;

a fill tube extending into said passageway of said hood to dispense product for filling said pouch; and means for moving said pouch into said passageway to said fill tube, said means for moving supporting said opening of said pouch in said pressurized gas while product from said fill tube is dispensed into said pouch said means including a turret for moving said pouches through said passageway, said turret having a plurality of stations, said hood extending over at least one station, said turret having an opening station upstream of said hood.

2. The apparatus as set forth in claim 1, further comprising a first nozzle mounted to said hood and extending into said passageway upstream of said fill tube for injecting gas into said pouch to purge oxygen from said pouch.

3. The apparatus as set forth in claim 2, further comprising means for reciprocally moving said nozzle in a vertical direction to move said nozzle into and away from said pouch.

4. The apparatus of claim 1, further comprising a second nozzle mounted to said hood and extending into said passageway downstream of said fill tube for injecting a supply of gas into said pouch, to purge oxygen from said pouch.

5. The apparatus as set forth in claim 1, wherein said hood further comprises a collar extending around said fill tube and fluidly connected to said supply of gas, said collar delivering a supply of gas around said fill tube.

6. The apparatus of claim 1, wherein said means for moving comprises a turret.

7. The apparatus of claim 1, wherein said means for dispersing comprises a dispersion plate mounted to said hood and having a plurality of perforations.

8. An apparatus for filling a pouch having an opening with a product, said apparatus comprising:

a hood having at least one wall defining a passageway, said passageway being open to air from outside said hood, said hood having means for dispersing pressurized gas into said passageway to displace said air from outside said hood, said means for dispersing comprising a dispersion plate mounted to said hood and having a plurality of perforations;

a fill tube extending into said passageway of said hood to dispense product for filling said pouch; and means for moving said pouch into said passageway to said fill tube, said means for moving supporting said opening of said pouch in said pressurized gas while product from said fill tube is dispensed into said pouch.

9. The apparatus as set forth in claim 8, further comprising a first nozzle mounted to said hood and extending into said passageway upstream of said fill tube for injecting gas into said pouch to purge oxygen from said pouch.

10. The apparatus as set forth in claim 9, further comprising means for reciprocally moving said nozzle in a vertical direction to move said nozzle into and away from said pouch.

11. The apparatus of claim 8, further comprising a second nozzle mounted to said hood and extending into said passageway downstream of said fill tube for injecting a supply of gas into said pouch to purge oxygen from said pouch.

12. The apparatus as set forth in claim 8, wherein said hood further comprises a collar extending around said fill tube and fluidly connected to said supply of gas, said collar delivering a supply of gas around said fill tube.

13. The apparatus of claim 8, wherein said means for moving comprises a turret.

14. The apparatus of claim 8, wherein said means for dispersing comprises a dispersion plate mounted to said hood and having a plurality of perforations.

* * * * *